US005537986A

United States Patent [19]

Summers

[11] Patent Number: 5,537,986

[45] Date of Patent: Jul. 23, 1996

[54] BOW NOCK DEVICE

[76] Inventor: Daniel A. Summers, 84 Brandywine Dr., Madison Heights, Va. 24572

[21] Appl. No.: 293,240

[22] Filed: Aug. 19, 1994

[51] Int. Cl.[6] ..... F41B 5/00; F41B 5/18

[52] U.S. Cl. ..... 124/91

[58] Field of Search ..... 124/35.2, 90, 91, 124/92, 86

[56] References Cited

U.S. PATENT DOCUMENTS

| | | | |
|---|---|---|---|
| 2,905,166 | 9/1959 | Niemeyer | 124/91 |
| 4,930,485 | 6/1990 | Kopper | 124/91 |
| 4,981,128 | 1/1991 | Garvison | 124/35.2 |

*Primary Examiner*—Erick K. Nicholson
*Assistant Examiner*—John A. Ricci

[57] ABSTRACT

Disclosed is a new bow nock device for use with a conventional release aid for extending the useful life of a bowstring by eliminating wear caused by the release aid and additionally for improving accuracy by aligning an arrow directly in front of the release aid to maintain the arrow at a 90° angle relative the longitudinal axis of the bow during the entire arrow release process. The bow nock device comprises a U-shaped member attachable to the bowstring for gripping by the release aid and for positioning a nocked end of the arrow between the ends thereof. The U-shaped member has a bowstring receiving groove formed on each end, each groove having a flared mouth for preventing bowstring chafing, and internal facing protrusions co-pending with the end of the arrow for stabilizing the same. Two fastening plates, attached to the U-shaped member with flat head machine screws, hold the bowstring within the bowstring receiving grooves whereby clampedly retaining the bowstring within the grooves.

14 Claims, 3 Drawing Sheets

FIG. 1
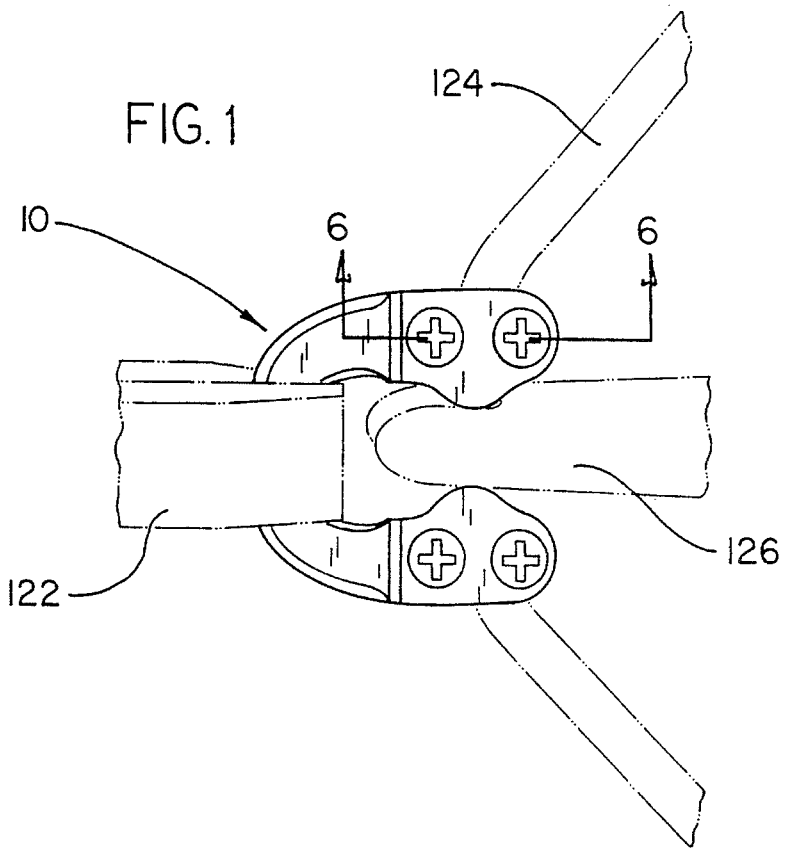
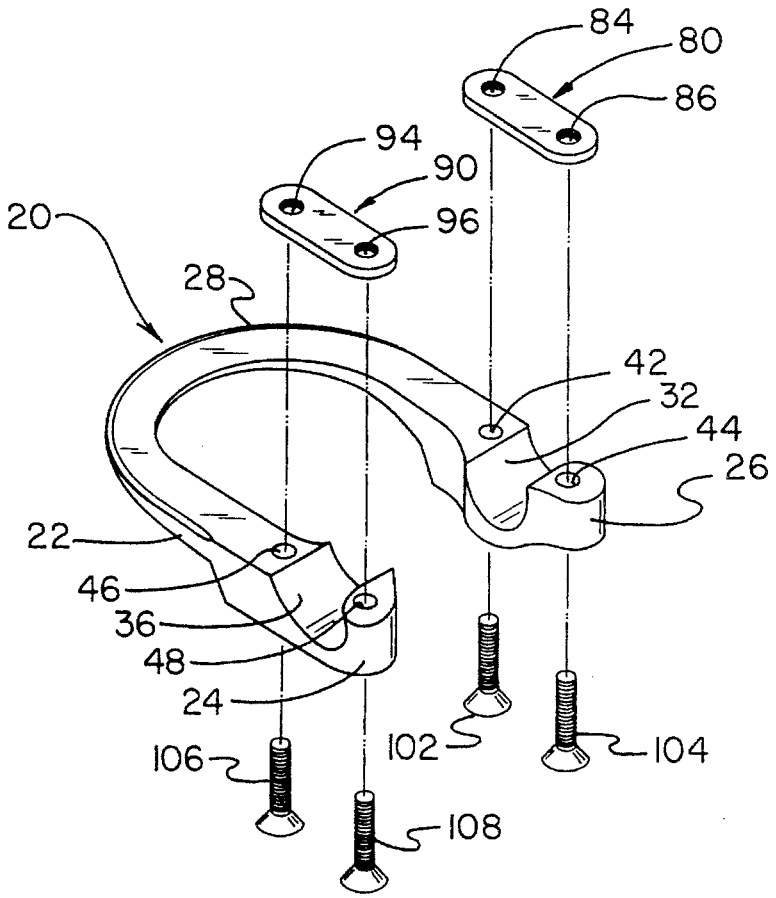
FIG. 2

BOW NOCK DEVICE

BACKGROUND OF THE INVENTION

1. Field of the Invention

The present invention relates to archery bow string release aids and more particularly pertains to a bow nock device which may be adapted for use with a conventional release aid for extending the useful life of a bowstring by eliminating wear caused by the release aid chafing the bowstring and additionally for improving accuracy by aligning an arrow directly in front of the release aid to maintain the arrow at a 90° angle relative the longitudinal axis of the bow during the entire arrow release process.

2. Description of the Prior Art

The use of archery bow string release aids is known in the prior art. More specifically, archery bow string release aids heretofore devised and utilized for the purpose of holding a fully drawn bow with nocked arrow until released by an archer are known to consist basically of familiar, expected and obvious structural configurations, notwithstanding the myriad of designs encompassed by the crowded prior art which have been developed for the fulfillment of countless objectives and requirements.

The present invention is directed to improving devices for holding a fully drawn bow with nocked arrow until released by an archer in a manner which is safe, secure, economical and aesthetically pleasing.

In this respect, the bow nock device according to the present invention substantially departs from the conventional concepts and designs of the prior art, and in so doing provides an apparatus primarily developed for use with a conventional release aid for extending the useful life of a bowstring and for improving accuracy.

Therefore, it can be appreciated that there exists a continuing need for a new bow nock device which can be used with a conventional release aid for extending the useful life of a bowstring by eliminating wear caused by the release aid chafing the bowstring and additionally for improving accuracy by aligning an arrow directly in front of the release aid to maintain the arrow at a 90° angle relative the longitudinal axis of the bow during the entire arrow release process. In this regard, the present invention substantially fulfills this need.

As illustrated by the background art, efforts are continuously being made in an attempt to develop devices for holding a fully drawn bow with nocked arrow until released by an archer. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of archery bow string release aids now present in the prior art, the present invention provides a new archery bow string release aid construction wherein the same can be utilized with a conventional release aid for extending the useful life of a bowstring by eliminating wear caused by the release aid chafing the bowstring and additionally for improving accuracy by aligning an arrow directly in front of the release aid to maintain the arrow at a 90° angle relative the longitudinal axis of the bow during the entire arrow release process. As such, the general purpose of the present invention, which will be described subsequently in greater detail, is to provide a new bow nock device apparatus and method which has all the advantages of the prior art archery bow string release aids and none of the disadvantages.

The invention is defined by the appended claims with the specific embodiment shown in the attached drawings. For the purpose of summarizing the invention, the invention may be incorporated into a new bow nock device for use with a conventional release aid for extending the useful life of a bowstring and for improving accuracy.

The bow nock device comprises a U-shaped member attachable to the bowstring for gripping by the release aid and for positioning a nocked end of the arrow between the ends thereof. The U-shaped member has a transverse bowstring receiving groove formed on a first side of each end. Each groove has an eccentrically positioned flared mouth formed on an external end thereof for preventing bowstring chafing. The U-shaped member additionally has internal facing protrusions formed proximal each end thereof copending with the end of the arrow for stabilizing the same. Each end of the U-shaped member further has a pair of countersunk through holes, the countersinks being formed on a second side of the U-shaped member opposite the bowstring receiving grooves.

Two fastening plates hold the bowstring within the bowstring receiving grooves. Each fastening plate has two threaded through holes. A flat head machine screw extends through each of the countersunk holes of the U-shaped member, the bevelled portion of the screw heads being received within bevelled portion of the countersunk holes. The screws are also threadedly engaged with the threaded holes of the fastening plates whereby clampedly retaining a bowstring positioned within the bowstring receiving grooves.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new bow nock device for use with a conventional release aid for extending the useful life of a bowstring by eliminating wear caused by the release aid chafing the bowstring.

It is another object of the present invention to provide a new bow nock device which may be easily and efficiently manufactured and marketed.

It is a further object of the present invention to provide a new bow nock device which is of a durable and reliable construction.

An even further object of the present invention is to provide a new bow nock device which is susceptible of a low cost of manufacture with regard to both materials and labor, and which accordingly is then susceptible of low prices of sale to the consuming public, thereby making such bow nock devices economically available to the buying public.

Still yet another object of the present invention is to provide a new bow nock device which provides in the apparatuses and methods of the prior art some of the advantages thereof, while simultaneously overcoming some of the disadvantages normally associated therewith.

Still yet another object of the present invention is to provide a new bow nock device that improves accuracy by aligning an arrow directly in front of the release aid to maintain the arrow at a 90° angle relative the longitudinal axis of the bow during the entire arrow release process.

Yet another object of the present invention is to provide a new bow nock device that prevents a nocked arrow from falling from bowstring at full draw.

Even still another object of the present invention is to provide a new bow nock device that works with most conventional release aids without requiring modification to the bow nock device or the release aid.

Yet still another object of the present invention is to provide a new bow nock device that is quick and easy to install, reducing the time required to tune the bow.

Even yet another object of the present invention is to provide a new bow nock device that may be used to align a peep sight thereby eliminating the need for additional peep sight alignment hardware.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of the preferred embodiment of the new bow nock device shown installed on a bowstring and interacting with a release aid and nocked arrow.

FIG. 2 is an exploded view of the invention of FIG. 1 showing its manner of construction.

DESCRIPTION OF THE PREFERRED EMBODIMENT

Figure 3:
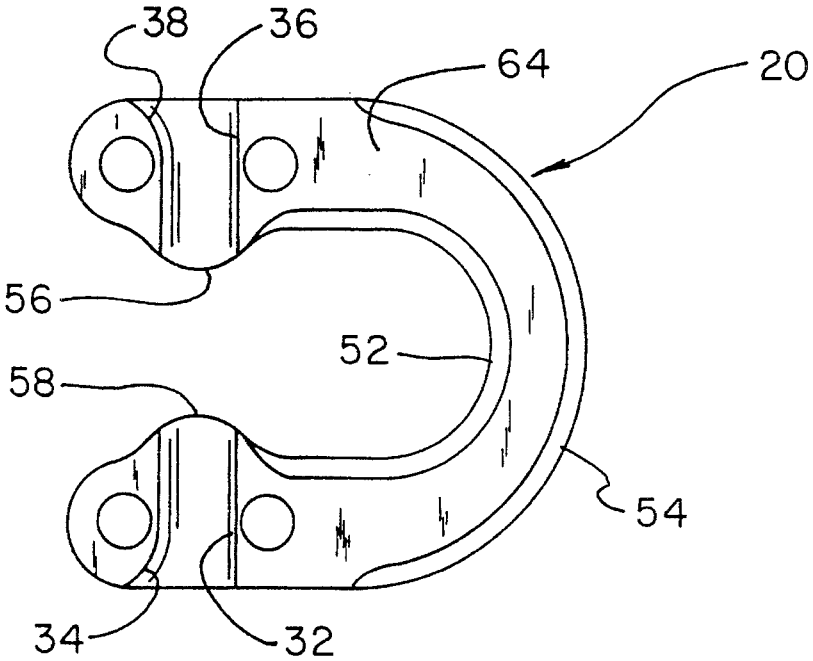
FIG. 3 is a side elevational view of the U-shaped member of the invention of FIG. 1 showing its first side.

With reference now to the drawings, and in particular to FIG. 1 thereof, a new bow nock device embodying the principles and concepts of the present invention and generally designated by the reference numeral 10 will be described.

From an overview standpoint, the bow nock device is adapted for use with a conventional release aid for extending the useful life of a bowstring by eliminating wear caused by the release aid chafing the bowstring and additionally for improving accuracy by aligning an arrow directly in front of the release aid to maintain the arrow at about a 90 degree angle relative to the longitudinal axis of the bow during the entire arrow release process. See FIG. 1.

The internal facing protrusions more than stabilize the nock end of the arrow. The arrow is rarely at a true 90 degree angle to the nocking device or bow string. These half-moon lobes allow the arrow to free float or pivot and change angle approximately plus or minus 10 degrees within the nocking device while maintaining a true nocking point of the arrow on the bow string, therefore allowing a clean arrow flight without the arrow binding in the nocking device. Without these lobes the pressures exerted on the arrow at full draw would cause a slight downward bend in the arrow and a pre-loading or the arrow rest which also causes poor arrow flight.

Figure 4:
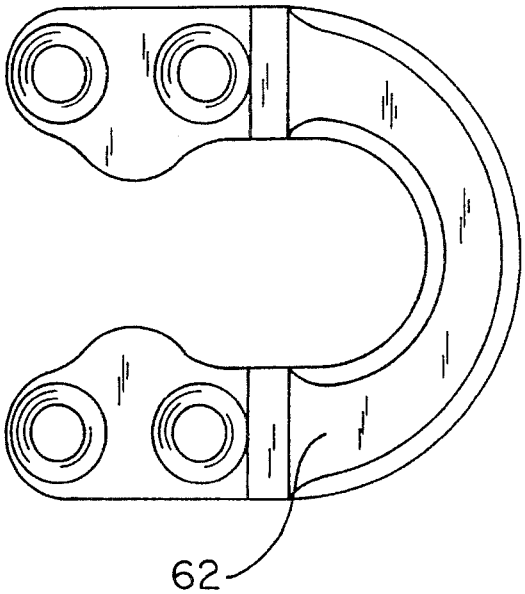
FIG. 4 is a side elevational view of the U-shaped member of the invention of FIG. 1 showing its second side.
Figure 5:
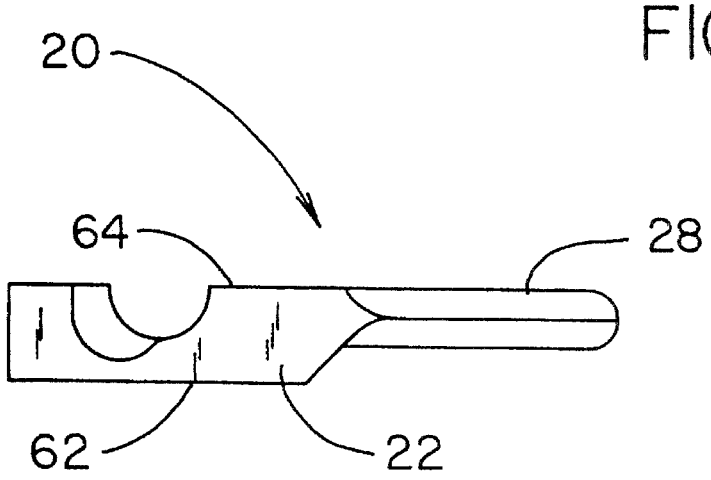
FIG. 5 is a top plan view of the U-shaped member of the invention of FIG. 1.
Figure 6:
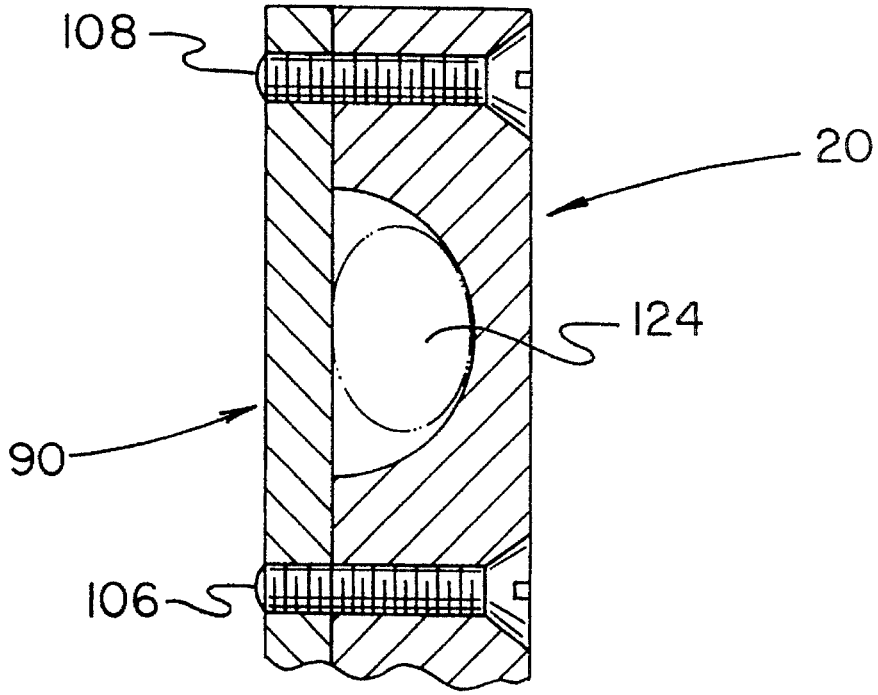
FIG. 6 is a sectional view of the invention of FIG. 1 taken along the line 6—6.

With reference now to FIGS. 1–6 and more specifically, it will be noted that a new bow nock device 10 for use with a conventional release aid 122 is shown.

The bow nock device 10 comprises a U-shaped member 20, formed of 7075-T6 aluminum alloy, attachable to the bowstring 124 for gripping by the release aid 122 and for positioning a nocked end 126 of the arrow between the ends 24 and 26 thereof. The U-shaped member 20 has a transverse bowstring receiving groove 32 and 36 formed on a first side 64 of each end 26. Each groove 32 and 36 has an eccentrically positioned flared mouth 34 and 38 formed on an external end thereof for preventing bowstring chafing. The U-shaped member 20 additionally has internal facing protrusions 56 and 58 formed proximal each end 24 and 26 thereof co-pending with the end 126 of the arrow for stabilizing the same. Each end 24 and 26 of the U-shaped member 20 also has a pair of countersunk through holes 46 and 48, 42 and 44, the countersinks being formed on a second side 62 of the U-shaped member 20 opposite the bowstring receiving grooves 32 and 36. The U-shaped member 20 has a maximum thickness at the ends 32 and 36 for clamping around the bowstring 124, tapering to a minimum thickness at the arcuate portion 28 to enable release aid engagement. The arcuate portion 28 is also radiused on both edges 52 and 54 to approximate the cross-sectional profile of a bowstring for proper release aid engagement therewith. The U-shaped member 20 is anodized for improved durability.

Two stainless steel fastening plates 80 and 90 hold the bowstring 124 within the bowstring receiving grooves 32 and 36. Each fastening plate 80 and 90 has two threaded through holes 84 and 86 (and 94 and 96). A stainless steel flat head machine screw 102, 104, 106, and 108 extends through each of the countersunk holes 42, 44, 46, and 48 of the U-shaped member 20, the bevelled portion of the screw heads being received within bevelled portion of the countersunk holes. The screws 102, 104, 106, and 108 are also threadedly engaged with the threaded holes 84, 86, 94, and 96 of the fastening plates 80 and 90 whereby clampedly retaining a bowstring 124 positioned within the bowstring receiving grooves 32 and 36.

The two fastening plates are concave on one side and convex on the other. During assembly of the nocking device, it is necessary to put the convex side against the bow string. This convex feature is substantial to the life or chafing of the bow string.

The nocking device is of a short design. The shorter the nocking device the less chance of the same hitting and damaging the cables on a compound bow. This also cuts down on the weight of the nocking device. Cutting weight is important since every grain decreases arrow speed.

The present invention is made to work with most release aids including a caliper. Further, the clamping design of this device allows it to easily be moved to different locations on the bow string without damage to the device. Once the screws are tightened it will not move. In addition, this device also repeatedly aligns the shooter's peep sight.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. Inasmuch as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed is:

1. A new bow nock device for use with a conventional release aid for extending the useful life of a bowstring by eliminating wear caused by the release aid chafing the bowstring and additionally for improving accuracy by aligning an arrow directly in front of the release aid to maintain the arrow at about a 90 degree angle relative the longitudinal axis of the bow during the entire arrow release process, the bow nock device comprising:

a U-shaped member attachable to the bowstring for gripping by the release aid and for positioning a nocked end of the arrow between the ends thereof, the U-shaped member having a transverse bowstring receiving groove formed on a first side of each end thereof, each groove having an eccentrically positioned flared mouth formed on an external end thereof for preventing bowstring chafing, the U-shaped member additionally having internal facing protrusions formed proximal each end thereof co-pending with the end of the arrow for stabilizing the same, each end of the U-shaped member further having a pair of countersunk through holes, the countersinks being formed on a second side of the U-shaped member opposite the bowstring receiving grooves;

two fastening plates for holding the bowstring within the bowstring receiving grooves, each fastening plate having two threaded through holes; and a flat head machine screw extending through each portion of the countersunk hole of the U-shaped member, the bevelled portion of the screw heads being received within bevelled portion of the countersunk holes, the screws also being threadedly engaged with the threaded holes of the fastening plates whereby clampedly retaining a bowstring positioned within the bowstring receiving grooves.

2. The bow nock device of claim 1 wherein the U-shaped member is formed of 7075-T6 aluminum alloy.

3. The bow nock device of claim 2 wherein the U-shaped member is anodize plated.

4. The bow nock device of claim 3 wherein the fastening plates are formed of stainless steel.

5. The bow nock device of claim 4 wherein the flat head machine screws are formed of stainless steel.

6. A new bow nock device for use with a conventional release aid for extending the useful life of a bowstring by eliminating wear caused by the release aid chafing the bowstring and additionally for improving accuracy by aligning an arrow directly in front of the release aid to maintain the arrow at approximately a 90 degree angle relative the longitudinal axis of the bow during the entire arrow release process, the bow nock device comprising:

a U-shaped member attachable to the bowstring for gripping by the release aid and for positioning a nocked end of the arrow between the ends thereof; and attachment means for attaching the U-shaped member to the bowstring such that the bowstring bridges the ends of the U-shaped member, the attachment means comprising a transverse bowstring receiving groove formed on a first side of each end of the U-shaped member with a flared mouth formed on an external end thereof for preventing bowstring chafing and a fastening means for holding the bowstring within the bowstring receiving grooves.

7. The bow nock device of claim 6 wherein the fastening means comprises a pair of through holes formed in each end of the U-shaped member, two fastening plates, each fastening plate having two threaded holes, and a screw extending through each of the through holes of the U-shaped member, the screws also being threadedly engaged with the threaded holes of the fastening plates whereby clampedly retaining a bowstring positioned within the bowstring receiving grooves.

8. The bow nock device of claim 7 wherein the through holes of the U-shaped member are countersunk, the countersinks being formed on a second side of the U-shaped member opposite the bowstring receiving grooves.

9. The bow nock device of claim 8 wherein the machine screws are flat head machine screws, the bevelled portion of the screw heads being received within bevelled portion of the countersunk holes.

10. The bow nock device of claim 9 and further comprising internal facing protrusions formed proximal each end thereof co-pending with the end of the arrow for stabilizing the same.

11. The bow nock device of claim 10 wherein the U-shaped member is formed of 7075-T6 aluminum alloy.

12. The bow nock device of claim 11 wherein the U-shaped member is anodize plated.

13. The bow nock device of claim 12 wherein the fastening plates are formed of stainless steel.

14. The bow nock device of claim 13 wherein the screws are formed of stainless steel.

* * * * *